United States Patent [19]

Lohse

[11] 4,242,837

[45] Jan. 6, 1981

[54] FINE GRINDING APPARATUS

[76] Inventor: Siegfried Lohse, Stenbreite 18, Fuldabrück 1, Fed. Rep. of Germany, 3501

[21] Appl. No.: 50,958

[22] Filed: Jun. 22, 1979

[30] Foreign Application Priority Data

Jun. 23, 1978 [DE] Fed. Rep. of Germany ..... 2827543

[51] Int. Cl.[3] ..... B24B 35/00

[52] U.S. Cl. ..... 51/59 R

[58] Field of Search ..... 51/59 R, 60, 165, 93

[56] References Cited

U.S. PATENT DOCUMENTS

| | | | |
|---|---|---|---|
| 327,288 | 9/1885 | Maloy | 51/59 R |
| 2,278,657 | 4/1942 | Kline | 51/59 R |
| 3,161,992 | 12/1964 | Gentry | 51/59 R X |
| 3,959,929 | 6/1976 | Fleischmann | 51/68 |

FOREIGN PATENT DOCUMENTS

| | | | |
|---|---|---|---|
| 868410 | 2/1953 | Fed. Rep. of Germany . | |
| 899913 | 12/1953 | Fed. Rep. of Germany | 51/59 R |

*Primary Examiner*—Gary L. Smith
*Attorney, Agent, or Firm*—Karl F. Ross

[57] ABSTRACT

A fine-grinding machine has a stationary stand on which a workpiece is fixed and which has a vertically adjustable arm carrying a tube defining a tube axis and displaceable angularly and axially on the arm relative to its axis. A tool mount adapted to hold a fine-grinding tool and having a tool axis generally parallel to the tube axis is mounted on the tube for displacement along a diameter through the tube axis. The tube can be set at any angular position for adjustment of the diametrical direction of displacement of this tool mount. A central shaft angularly and axially displaceable in the tube has an inclined pin at one end engaging the tool mount so that the axial position of the tube determines the eccentricity of the tool axis relative to the tube axis. Rotation of this central shaft therefore will reciprocate the tool mount diametrically of the tube to an extent determined by this eccentricity. Finally the entire tube, mount, and shaft can be vertically reciprocated to finish the upright inner side walls of the recess in a workpiece.

10 Claims, 5 Drawing Figures

FINE GRINDING APPARATUS

FIELD OF THE INVENTION

The present invention relates to a fine-grinding apparatus. More particularly this invention concerns a fine-grinding or lapping apparatus for finish-machining the inside of a recess in a workpiece.

BACKGROUND OF THE INVENTION

A fine-grinding machine is known from German Pat. No. 868,410 issued Jan. 15, 1953 to Karl Krümmel. This device is adapted to be mounted on the tool post of a lathe for mirror finishing a shaft. It has an electric motor which rotates a tube shaft inside of which is provided a shaft carrying an eccentric. The angular position of the central shaft and outer tube shaft can be changed to vary the extent of eccentricity of the eccentric carried by the central shaft. This eccentric rides in a bearing in turn riding in a slot in a tool mount that is reciprocal in a direction perpendicular to this slot. Thus, as the motor rotates the tube and central shafts, the eccentric will orbit about the axis of the tube shaft and will reciprocate the tool mount in its guide. As the degree of eccentricity of the eccentric is increased relative to the tube-shaft axis the diametrical stroke of the tool mount will increase, and vice versa.

This apparatus has shown itself relatively useful in the limited application to which it is intended, that is mirror-finishing the exterior of a shaft or the like. In view of the considerable complexity of the structure of even this simple device it has been considered impossible to overcome its lack of versatility to use it for other finishing jobs.

U.S. Pat. No. 3,959,929 issued June 1, 1976 to Johann Fleischmann et al shows another such arrangement wherein the grinding device is mounted on an arm of a tool stand. The tool itself in this arrangement is rotatable about a vertical axis and can simultaneously be reciprocated vertically. In order to be able to machine surfaces that are not perfectly horizontal relative to the workpiece, the entire machining arrangement can be tipped on the arm, in the fashion of a raidal-arm drill press or saw, to have a different angle of attack. The workpiece is normally mounted with two degrees of freedom of motion, that is for at least limited free displacement in a plane. Such a tool cannot, however, machine horizontal upper surfaces of a workpiece.

A disadvantage of the known machine is the inability to finish recesses produced by electro-discharge machining (EDM). It is known to use a diamond paste or similar abrasive agents between the EDM tool and the workpiece. Such arrangements, however, normally require that not only the base of the recess be finished, but also the sides thereof. This normally requires a special-duty machine or two separate machines.

OBJECTS OF THE INVENTION

It is therefore an object of the present invention to provide an improved fine-grinding or lapping machine.

Another object is to provide such a machine which can be used for varied grinding applications, that is for finishing flat horizontal surfaces, for finishing the inner side walls of recesses, and even for finishing the bases of recesses.

Another object is to provide such a device particularly adapted for use with EDM systems and tools.

SUMMARY OF THE INVENTION

These objects are attained according to the instant invention in a fine-grinding machine having a stationary stand provided with an arm and a workpiece holder. A tube is mounted on this arm for displacement angularly and axially relative to its longitudinal central axis. A tool mount adapted to hold the tool and having a tool axis generally parallel to the tube axis is mounted on this tube for displacement of the tool axis along a diameter through the tube axis and fixed angularly relative to this tube. Adjustment means is provided for rotating the tube on the arm about the tube axis for locking this tube in any of a plurality of angularly offset positions to adjust the angular orientation of the diameter along which the tool mount can move relative to the tube. A shaft is angularly and axially displaceable in the tube and has an end provided with a pin inclined to the tube axis and operatively engaging the tool mount in such a manner that the axial position of the shaft determines the eccentricity of the tool axis relative to the tube axis. Further adjustment means is provided for axially displacing this shaft in the tube and for locking this shaft in any of a plurality of axially offset positions to adjust the eccentricity of the tool axis relative to the tube axis. Drive means rotates the shaft about the tube axis relative to the tube so as to diametrically reciprocate the tool mount relative to the shaft through a diametrical stroke proportional to the eccentricity of the tool axis relative to the tube axis. Furthermore according to this invention it is possible to axially reciprocate the tube, shaft, and mount jointly so that a tool held thereby can be simultaneously axially and diametrically reciprocated.

According to this invention the workpiece can be clamped fixedly on the stand. In order to compensate for minor maladjustments the tool mount is provided with a tool holder that can move limitedly with two degrees of freedom, that is in a plane, relative to the tool mount. This plane, according to the invention, is perpendicular to the tool and the tube axes.

According to this invention the drive for the vertical axial reciprocation and for the rotation of the shaft have separate independently operable motors. Thus it is possible with the apparatus according to this invention to set up the machine so that it strokes diametrically through any desired stroke within a given range along any diameter of the tool axis, while it reciprocates vertically through any desired distance. Thus the machine is extremely versatile and can be used for tasks as mundane as surface finishing a workpiece, in which case the tube is not axially reciprocated, or for complex tasks such as finishing the base of the cylindrical recess in a workpiece hollowed out by an EDM apparatus.

According to further features of this invention the arm is itself vertically displaceable on the stationary stand. Thus it is possible to hydraulically or otherwise downwardly bias the arm so as to exert a continuous downward machining pressure with the system according to this invention. Similarly it is a relatively simple task to move the tool up out of the workpiece and to put a new workpiece in the machine.

SPECIFIC DESCRIPTION

Figure 1:
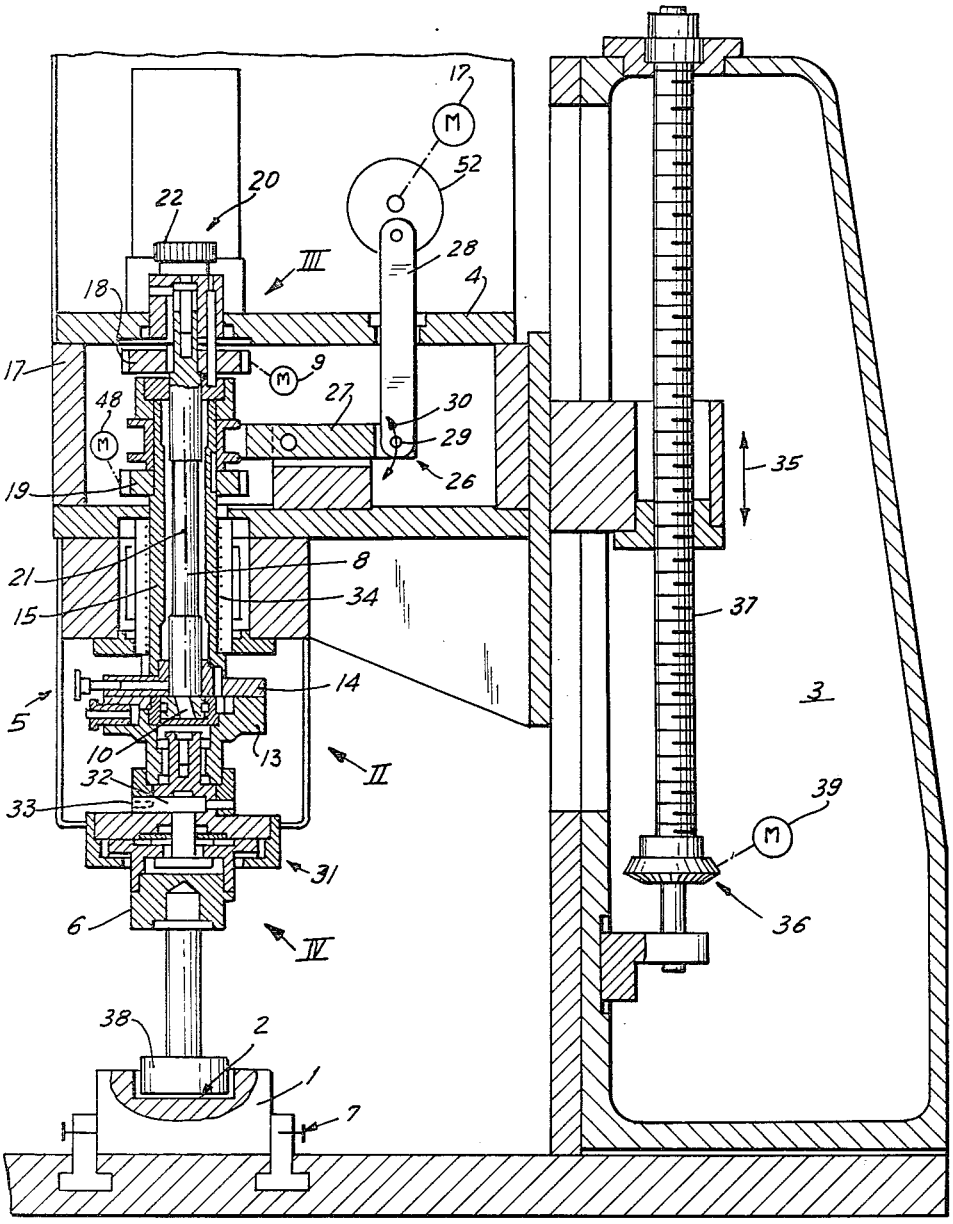
FIG. 1 is a side view of the machine according to this invention.

As shown in FIG. 1, the apparatus according to this invention serves to machine the recess 2 of the workpiece 1 with a tool 38. The workpiece 1 is fixedly held in a vise 7 adjacent a stand 3 from which an arm 4 extends horizontally, this arm 4 carrying at its outer end a fine-grinding device 5 holding the tool 38 by means of a toolholder 6. The entire arm 4 can be vertically displaced as shown by arrow 35 on the stand or frame 3 by rotation of a spindle 37 having a bevel gear 36 operable by a motor 39. This motor 39 is normally operated in accordance with sensing devices to exert a predetermined downward pressure on the workpiece 1 with the tool 38.

Figure 2:
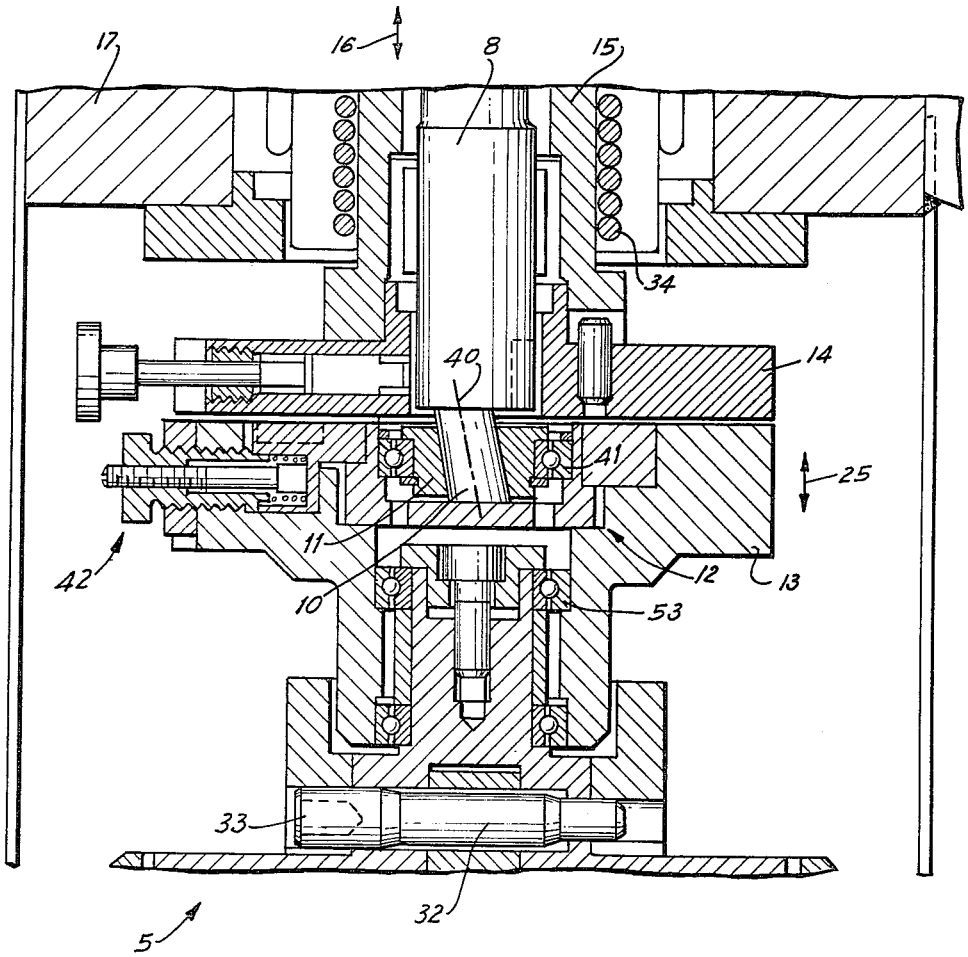
FIGS. 2, 3, and 4 are the details of the apparatus of FIG. 1 indicated at II, II, and IV, respectively, of FIG. 1.
Figure 3:
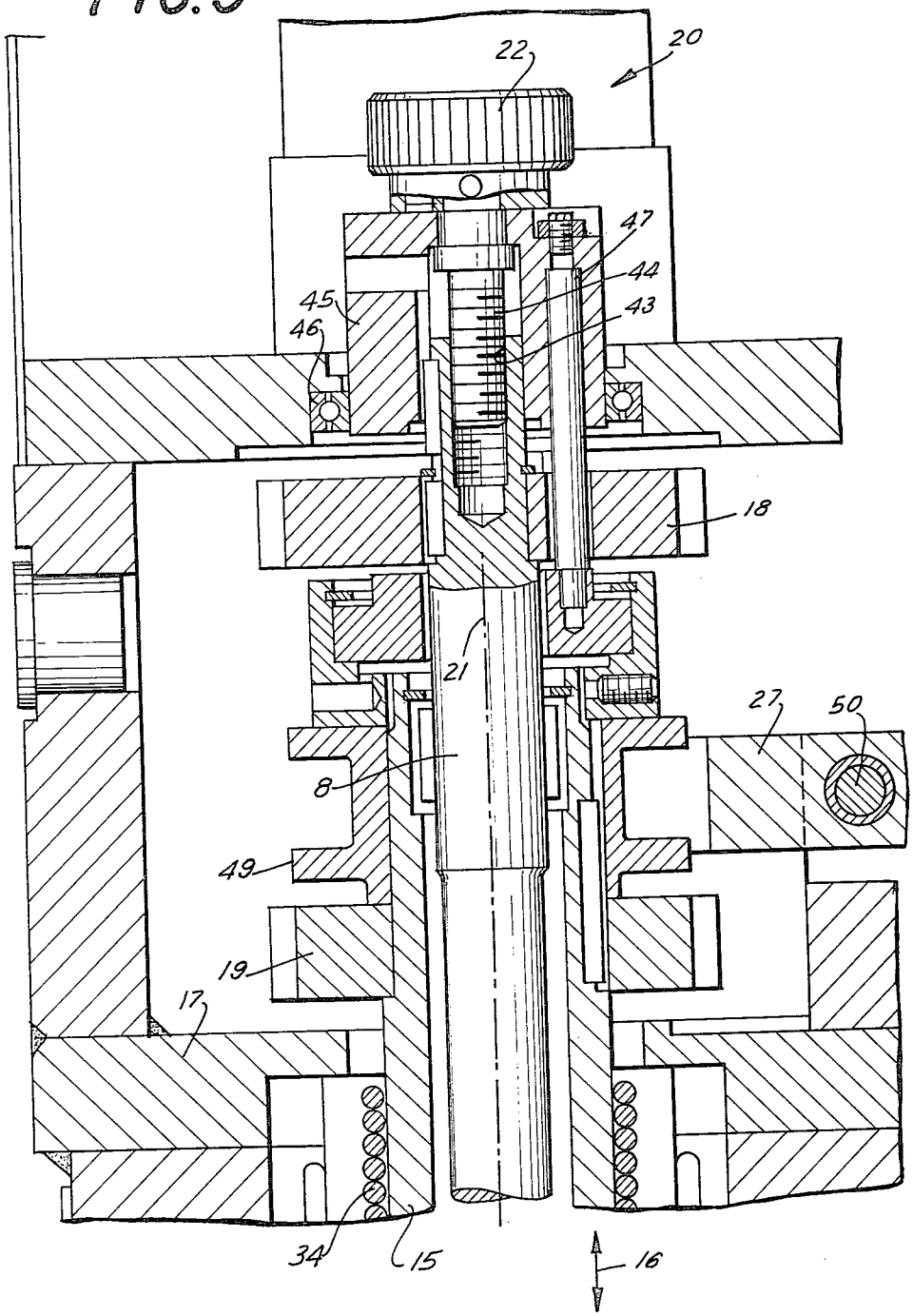
Figure 4:
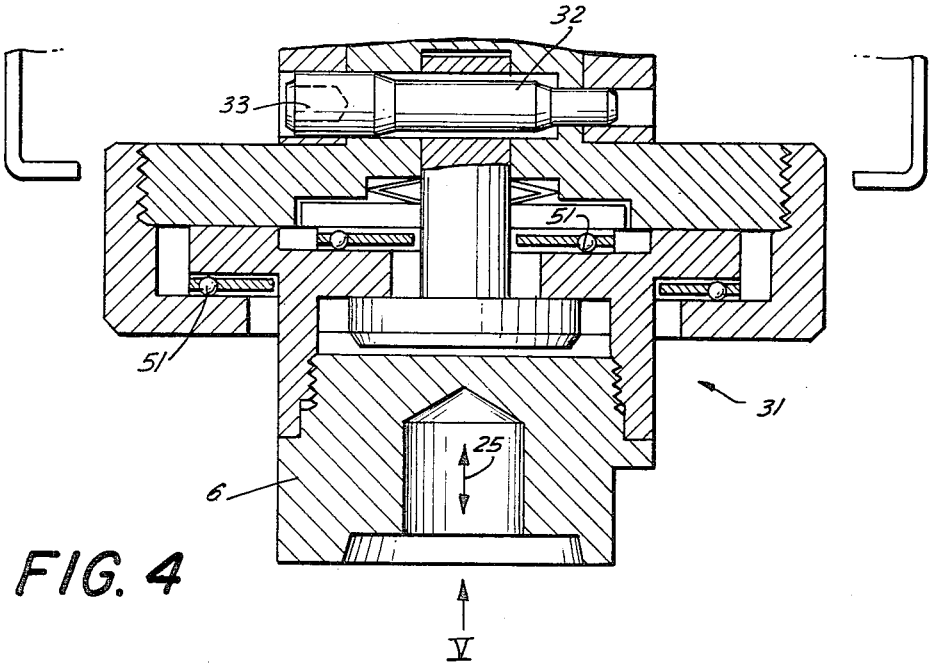

As better seen in FIGS. 2, 3, and 4 the fine-grinding device has a tube 15 defining a central axis 21 and mounted for displacement rotationally and axially of this axis 21 in a traveling-ball bearing 34 on the arm 4. Mounted via bearings inside this tube 15 is a shaft 8 whose lower end is provided with an inclined pin 10 having an axis 40 inclined at an acute angle to the axis 21 about which the shaft 8 is rotatable inside the tube 15. This pin 10 is cylindrical and received in a correspondingly inclined bore of a bushing 11 mounted via a bearing 41 in a tool mount 13 received in a guide 12 mounted in turn in a slide 14 for displacement of this mount 13 in a direction perpendicular to the axis 21 and to the plane of the view of FIG. 2. A tightening means 42 is provided to eliminate any displacement of the mount 13 relative to the tube 15 except in the diametrical direction defined by the guide 12 and slide 14.

The upper end of the shaft 8 is formed with a threaded bore 43 receiving a threaded spindle 44 of an adjustment device 20 having a knurled knob 22 connected to this threaded shaft 44. In addition the adjustment device 20 includes a bushing 45 mounted via a bearing 46 on the arm 4 and connected via a rod 47 to the tube 15 so that the bushing 45 and tube 15 are jointly axially displaceable. Rotation of the knob 20, which can be fixed at any angular position about the axis 21, therefore can displace the shaft 8 in either axial direction relative to the tube 15 as indicated by arrow 16. The shaft 8 is also keyed to a large pinion gear 18 to be rotated by a motor 9 (FIG. 1).

The tube 15 in turn is keyed to a large pinion gear 19 that itself can be angularly displaced by means of a motor 48 (FIG. 1). The tube 15 is not manually rotated except for adjustment.

In addition the tube 15 is axially fixed to a collar 49 engaged by a lever 27 pivoted at 50 on the arm 4 and at 29 on a link 28 displaceable as seen by arrow 30 by a drive 26 constituted as a crank 52 operated by a motor 17. Thus this drive 26 can vertically displace the tool mount 13 on its slide 14 as indicated by arrows 25 in FIG. 2.

The tool holder 6 itself, as seen in FIG. 4, is mounted by an arrangement 31 having roller bearings 51 for limited displacement relative to the tube 15 with two degrees of freedom, that is in a plane perpendicular to the axis 21. A tightening bolt 32 having an eccentric central portion and an Allen recess 33 permits any play between the tool holder 6 and the mount 13 parallel to the axis 21 to be eliminated. Similarly bearings 53 allow some rotation of the tool holder 6 about the axis 21 relative to the slide 13.

Figure 5:
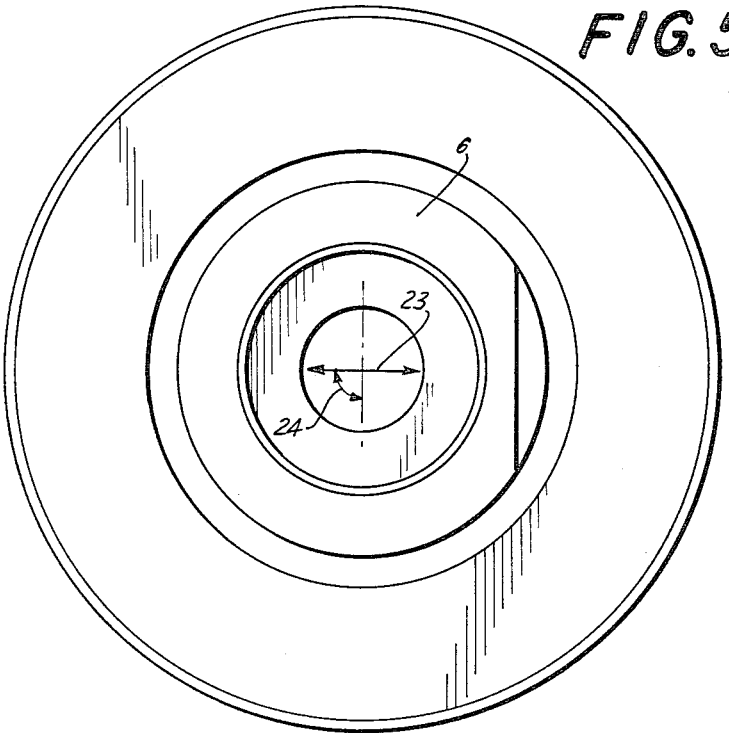
FIG. 5 is a view taken in the direction of V of FIG. 4.

Thus it is possible for the system according to the instant invention to be adjusted so that as seen in FIG. 5 the direction 23 of diametrical reciprocation of the tool holder 6 can be moved angularly about as indicated by arrow 24 through 360° for any desired orientation. In addition the extent of such diametrical reciprocation can be varied by the adjustment means 20. In the position of FIG. 2 rotation of the shaft 8 will not diametrically reciprocate the slide 13, but any lifting of the shaft 8 will offset the central axis of the tool mount of slide 13 relative to the axis 21 to effect such reciprocation.

The amount of vertical reciprocation as controlled by the drive 26 can similarly be adjusted, although such adjustment is normally not necessary, once the lowermost position of the tool 38 is defined, normally by means of the motor 39.

Thus the system according to the instant invention can be set up so as to perform virtually any desired fine-machining operation. It can merely move the lower face of the tool 39 in a horizontal plane, with the radial stroke determined by the adjustment apparatus 20 and a frequency established by the rotation rate of the motor 9. Continuous resetting of the angular position of this diametrical stroking by operation of the motor 48 can ensure good overlapping of adjacent machining strokes. At the same time vertical reciprocation by means of the drive 28 allows the inner sides of a recess in a workpiece to be finished also.

I claim:

1. A fine-grinding apparatus comprising:

a stationary stand having an arm and a workpiece holder;

a tube defining a tube axis;

means for mounting said tube on said arm for displacement angularly and axially thereon;

a tool mount adapted to hold a tool and having a tool axis generally parallel to said tube axis;

means for mounting said mount on said tube for displacement of said tool axis along a diameter through said axis and fixed angularly relative to said tube;

tube adjustment means for rotating said tube on said arm about said tube axis and for locking said tube in any of a plurality of angularly offset positions for adjustment of the angular orientation of said diameter on said tube;

a shaft angularly and axially displaceable in said tube and having an end provided with a pin inclined to said axis and operatively engaging said tool mount;

shaft adjustment means for axially displacing said shaft in said tube and for locking said shaft in any of a plurality of axially offset positions for adjustment of the eccentricity of said tool axis relative to said tube axis; and drive means for rotating said shaft about said tube axis relative to said tube and thereby diametrically reciprocating said tool mount relative to said shaft through a diametrical stroke proportional to said eccentricity of said tool axis.

2. The apparatus defined in claim 1, further comprising means for axially reciprocating said tube shaft, and mount jointly, whereby a tool held by said mount can be simultaneously axially and diametrically reciprocated.

3. The apparatus defined in claim 2 wherein said axis is upright.

4. The apparatus defined in claim 3 wherein said tool mount includes a tool holder and means for limited displacement of said holder with two degrees of freedom relative to said diameter.

5. The apparatus defined in claim 4 wherein said holder can move limitedly in a plane perpendicular to said axis relative to said axes.

6. The apparatus defined in claim 3 wherein said means for reciprocating said tube shaft and said means for rotating said tube shaft include respective independent motors.

7. The apparatus defined in claim 3, further comprising means for vertically positioning said arm with said tube in any of a plurality of vertically offset positions relative to said stand.

8. The apparatus defined in claim 3 wherein said workpiece holder includes a vise for fixedly positioning a workpiece relative to said stand.

9. The apparatus defined in claim 3 wherein said pin has a pin axis crossing said tube axis, said tool mount forming an inclined bore snugly receiving and complementary to said pin.

10. The apparatus defined in claim 3 wherein said tube mount includes a bearing defining said bore.

* * * * *